US007934611B2

(12) United States Patent
Clark et al.

(10) Patent No.: US 7,934,611 B2
(45) Date of Patent: May 3, 2011

(54) RACK ACCESSORIES

(75) Inventors: Jeremy A. Clark, Minneapolis, MN (US); Michael A. Whittier, Minneapolis, MN (US); David H. Cheney, Shoreview, MN (US); James S. LaRue, Fergus Falls, MN (US)

(73) Assignee: Target Brands, Inc., Minneapolis, MN (US)

( * ) Notice: Subject to any disclaimer, the term of this patent is extended or adjusted under 35 U.S.C. 154(b) by 407 days.

(21) Appl. No.: 12/098,330

(22) Filed: Apr. 4, 2008

(65) Prior Publication Data

US 2009/0250418 A1 Oct. 8, 2009

(51) Int. Cl.
*A47F 7/00* (2006.01)

(52) U.S. Cl. ..... 211/85.3; 211/189

(58) Field of Classification Search ..... 211/85.3, 211/187, 193, 189; 108/108; 206/300; 362/84, 362/147, 190, 191, 217.1, 217.11, 217.12, 362/217.13

See application file for complete search history.

(56) References Cited

U.S. PATENT DOCUMENTS

| | | | | |
|---|---|---|---|---|
| 2,710,241 | A | 6/1955 | Lieberman | |
| 3,297,374 | A | 1/1967 | Radek | |
| 3,346,124 | A * | 10/1967 | Sobel | 211/193 |
| 3,411,634 | A | 11/1968 | Pesce | |
| 3,601,256 | A | 8/1971 | Bowers, Jr. et al. | |
| 3,737,048 | A | 6/1973 | Giroux | |
| 3,830,374 | A * | 8/1974 | Kassimir | 211/1 |
| 3,856,320 | A * | 12/1974 | Blanchard | 280/47.35 |
| 3,865,250 | A | 2/1975 | Jay | |
| 4,046,083 | A | 9/1977 | Murdoch et al. | |
| 4,127,196 | A | 11/1978 | Boucher | |
| 4,191,298 | A | 3/1980 | Broudy | |
| 4,204,960 | A * | 5/1980 | Sugiyama et al. | 210/232 |
| 4,331,245 | A | 5/1982 | Schell | |
| 4,380,298 | A | 4/1983 | Harig | |
| 4,444,322 | A | 4/1984 | Lee | |
| 4,460,097 | A | 7/1984 | Darnell, II et al. | |

(Continued)

FOREIGN PATENT DOCUMENTS

EP 469223 A * 2/1992

OTHER PUBLICATIONS

Jeremy A. Clark et al., Tower Cover and Hoop Extender, Design U.S. Appl. No. 29/306,296, filed Apr. 4, 2008.

(Continued)

*Primary Examiner* — Korie Chan
(74) *Attorney, Agent, or Firm* — Griffiths & Seaton PLLC

(57) ABSTRACT

A retail system includes a rack assembly and a cover. The rack assembly has a stand that is adapted to rest on a substantially horizontal surface, where the stand is formed of a plurality of tubular members. The rack assembly also has a mounting frame that is substantially rectangular in shape and supported in a substantially vertical position by the stand. The cover includes a base portion that is formed by a combination of a first shell and a second shell that is complementary to the first shell, the base portion defining a hollow, substantially box-like structure that is supported in a substantially vertically position by the rack assembly and covers at least a portion of the mounting frame. The cover also includes a stack portion defining a hollow, substantially box-like structure that is adapted to slide over the mounting frame and mount atop the base portion.

24 Claims, 11 Drawing Sheets

U.S. PATENT DOCUMENTS 4,580,685 A 4/1986 Jorquez
4,609,975 A 9/1986 Badolato et al.
4,627,544 A 12/1986 Scarpa et al.
4,716,841 A 1/1988 Suttles
D295,802 S 5/1988 Abraham
4,841,689 A * 6/1989 Schussler ..... 52/64
4,925,038 A 5/1990 Gajewski
D318,194 S 7/1991 Terrell et al.
D319,934 S 9/1991 Terrell et al.
5,128,850 A 7/1992 Juodvalkis
5,140,918 A * 8/1992 Combepine et al. ..... 112/258
5,141,105 A 8/1992 Maye
5,272,991 A 12/1993 Carrigan, Jr.
5,274,938 A 1/1994 McDonald et al.
5,282,331 A 2/1994 Fell
5,433,046 A * 7/1995 MacQuarrie et al. ..... 52/238.1
5,535,898 A 7/1996 Burgess, Sr. et al.
5,584,398 A 12/1996 Lin
5,607,070 A 3/1997 Hellyer
5,611,442 A 3/1997 Howard
5,628,413 A 5/1997 Lu et al.
5,642,811 A * 7/1997 Hubner et al. ..... 206/391
5,653,349 A 8/1997 Dana et al.
5,660,637 A 8/1997 Dodge
D394,360 S 5/1998 Geier et al.
5,794,782 A * 8/1998 Ascik ..... 206/600
5,875,895 A 3/1999 Dardashti
D409,858 S 5/1999 Reed
5,918,750 A 7/1999 Jackson
5,921,190 A 7/1999 Wood
5,944,203 A 8/1999 Vlah et al.
D417,978 S 12/1999 Reed
6,029,833 A 2/2000 Yeh
6,053,115 A 4/2000 Felton
D427,457 S 7/2000 Heiny et al.
D442,398 S 5/2001 Waisbrod
D450,948 S 11/2001 Stafford et al.
D451,300 S 12/2001 Stafford et al.
6,427,855 B2 8/2002 LaBruna, Jr. et al.
D466,331 S 12/2002 Chang
D468,368 S 1/2003 Jones
D470,685 S 2/2003 Chang
D474,350 S 5/2003 Sardis
6,561,365 B2 5/2003 Bustos
6,561,366 B2 5/2003 Kim-So
6,669,037 B1 12/2003 Ahn
D495,523 S 9/2004 Harwanko
D501,888 S * 2/2005 Arceta ..... D20/10
6,935,523 B2 8/2005 Ahn
6,951,291 B2 10/2005 Kleanthis
6,959,824 B1 11/2005 Alperson
7,083,052 B1 8/2006 Morle
D570,630 S 6/2008 D'Angelo
D591,988 S * 5/2009 Clark et al. ..... D6/511

OTHER PUBLICATIONS

Jeremy A. Clark et al., Ceiling Hoop, Design U.S. Appl. No. 29/306,295, filed Apr. 4, 2008.

Jeremy A. Clark et al., Display Fixture Accessories, U.S. Appl. No. 11/627,262, filed Jan. 25, 2007.

* cited by examiner

RACK ACCESSORIES

CROSS-REFERENCE TO RELATED APPLICATIONS

This application is related to U.S. Des. patent application Ser. No. 29/306,295, filed on even date herewith, now U.S. Des. Pat. No. D605,349, issued Dec. 1, 2009, identified by , and entitled "Ceiling Hoop," the entire contents of which are incorporated herein by reference.

This application is related to U.S. Des. patent application Ser. No. 29/306,296, filed on even date herewith, now U.S. Des. Pat. No. D591,988, issued May 12, 2009, identified by , and entitled "Tower Cover and Hoop Extender," the entire contents of which are incorporated herein by reference.

BACKGROUND

Various types of displays are used to support and present merchandise and provide merchandise information and other information to consumers in a retail environment. Displays that are eye-catching and that readily provide information about a product help draw the attention of the customer and promote retail sales. Additionally, displays that are able to be efficiently set up, broken down, and adjustable are versatile, more easily shipped and stored, and adaptable for use with different base fixtures. Such displays provide a more efficient use of resources, including increased sales, better use of employee time, and reduced costs. While traditional displays accomplish these features to some extent, enhancements in the functionality, or overall merchandising effectiveness, of such displays remain to be realized.

SUMMARY

Some embodiments of the invention relate to a retail system that includes a rack assembly and a cover. The rack assembly has a stand that is adapted to rest on a substantially horizontal surface, where the stand is formed of a plurality of tubular members. The rack assembly also has a mounting frame that is substantially rectangular in shape and supported in a substantially vertical position by the stand. The cover includes a base portion that is formed by a combination of a first shell and a second shell that is complementary to the first shell, the base portion defining a hollow, substantially box-like structure that is supported in a substantially vertically position by the rack assembly and covers at least a portion of the mounting frame. The cover also includes a stack portion defining a hollow, substantially box-like structure that is adapted to slide over the mounting frame and mount atop the base portion.

Various other embodiments are contemplated and should be understood with reference to the text and drawings that follow.

Figure 1:
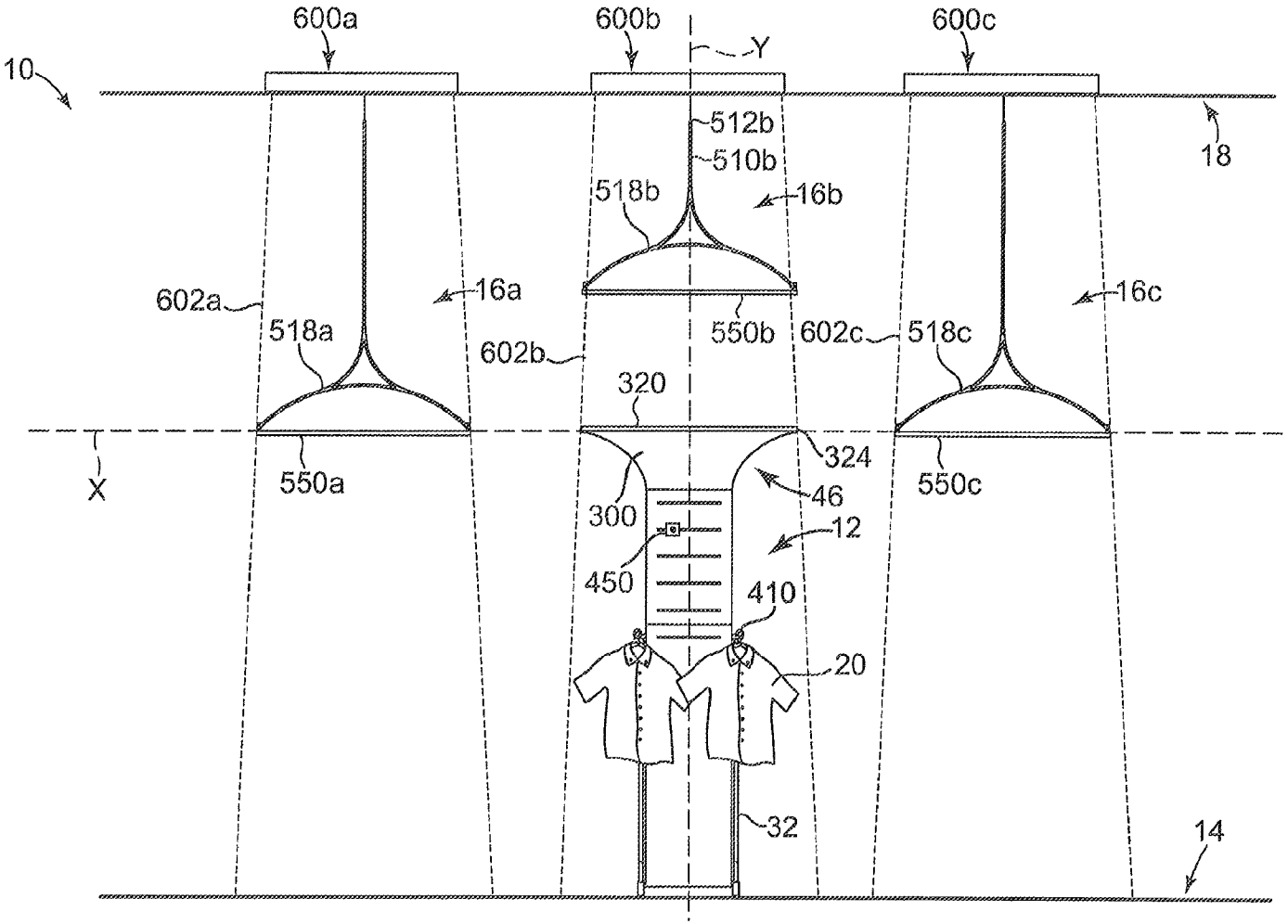
FIG. 1 shows a display system, according to some embodiments.

Some embodiments have been shown by way of example in the drawings and are described in detail below. As alluded to above, the intention, however, is not to limit the invention by those examples. On the contrary, the invention is intended to cover all modifications, equivalents, and alternatives.

DETAILED DESCRIPTION

FIG. 1 shows a display system 10, or retail system, according to embodiments of the invention. The display system 10 is used to support products, provide product information to consumers, and is adapted to be positioned in a multitude of visually effective arrangements. The display system 10 includes a floor display assembly 12 supported on a retail floor 14 and a ceiling display assembly or assemblies 16*a*, 16*b*, 16*c* (collectively referenced as ceiling display assemblies 16) hanging from a ceiling 18 over the retail floor 14. As shown, the floor display assembly 12 supports a plurality of products 20, such as clothing.

In some embodiments, the floor display assembly 12 and the ceiling display assemblies 16 are positioned to draw the observer's attention centrally to the floor display assembly 12 and upward from the retail floor 14 across the products 20, although a variety of other arrangements that draw the observer's attention to the products 20, or other focal point, are also contemplated. Additionally, or alternatively, the floor display assembly 12 and the ceiling display assemblies 16 are adapted to modify ambient lighting to provide a unique visual effect that is informative to the observer or is otherwise pleasing in nature. Still further yet, the floor display assembly 12 is optionally employed to augment retail fixture attachment points of a base fixture or adapt the floor display assembly 12 for use with different types of base fixtures, as will be subsequently described.

Figure 2:
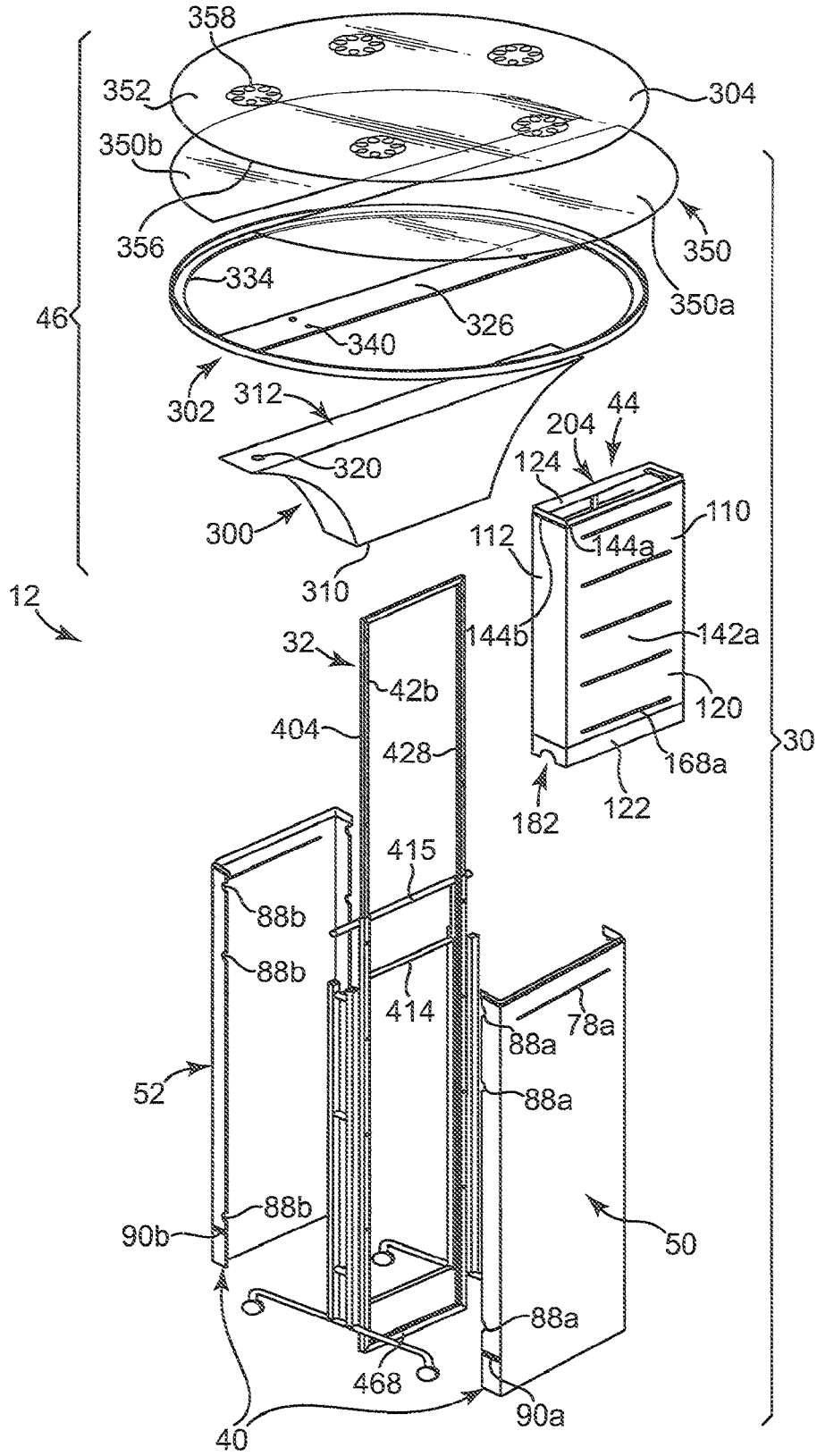
FIG. 2 is an exploded view of a floor display assembly of the system of FIG. 1, according to some embodiments.

FIG. 2 shows an exploded view of the floor display assembly 12, also described as a floor display. As shown, the floor display assembly 12 optionally includes a cover 30 and a rack fixture assembly 32, where the cover 30 is shown in an exploded, or unassembled state, in FIG. 2. The cover 30 provides means for covering the rack fixture assembly 32 and includes a skirt 40, a chimney 44 adapted to be mounted on top of the skirt 40, and a light treatment assembly 46 adapted to be mounted on top of the chimney 44.

Figure 3:
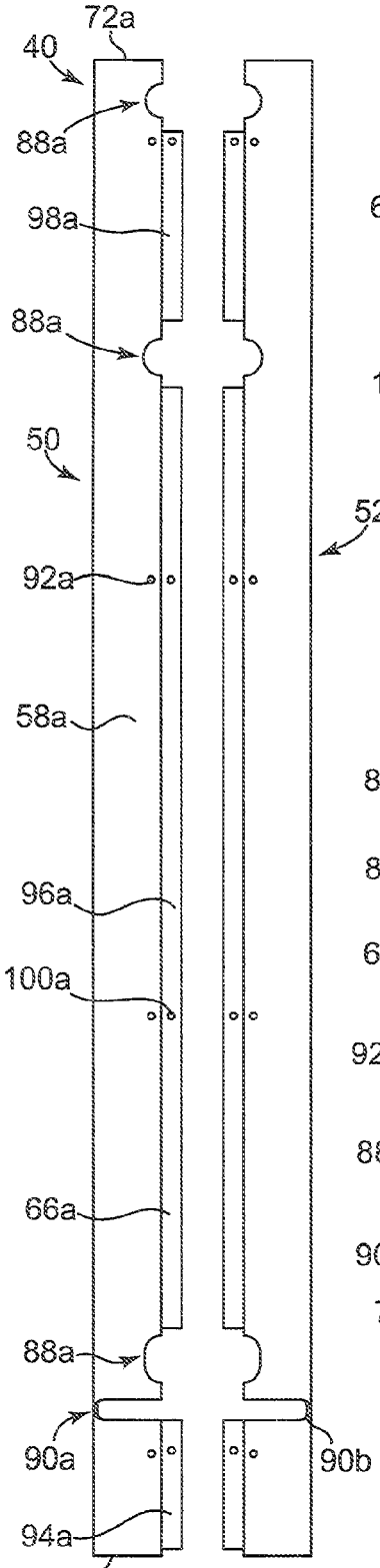
FIG. 3 is a side view of a skirt of the floor display assembly of FIG. 2 in an unassembled state, according to some embodiments.
Figure 4:
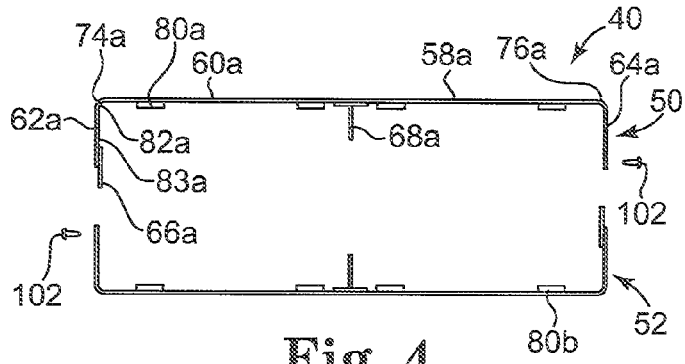
FIG. 4 is a top view of the skirt of the FIG. 3, according to some embodiments.
Figure 5:
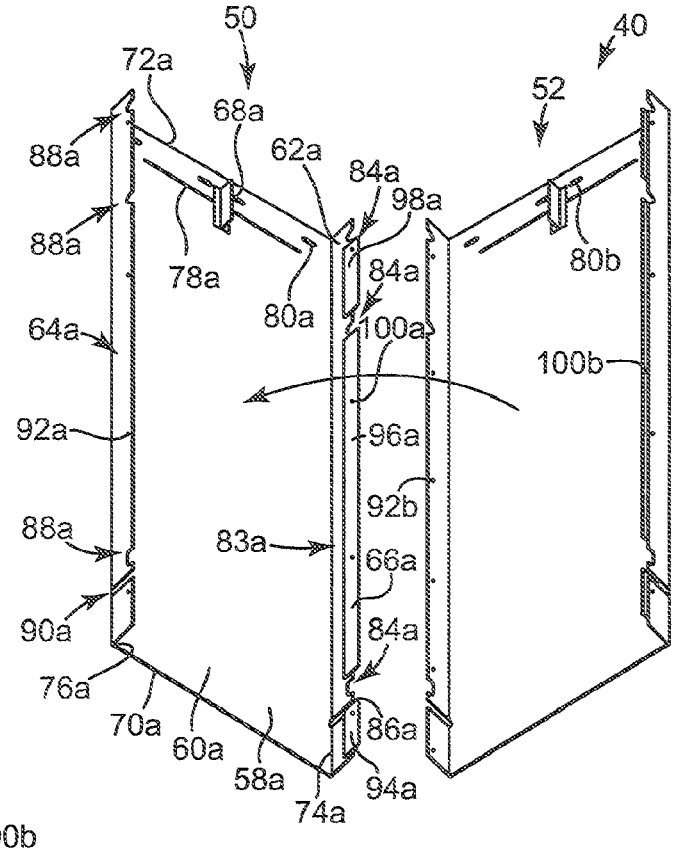
FIG. 5 is a perspective view of the skirt of FIG. 3, according to some embodiments.
Figure 18:
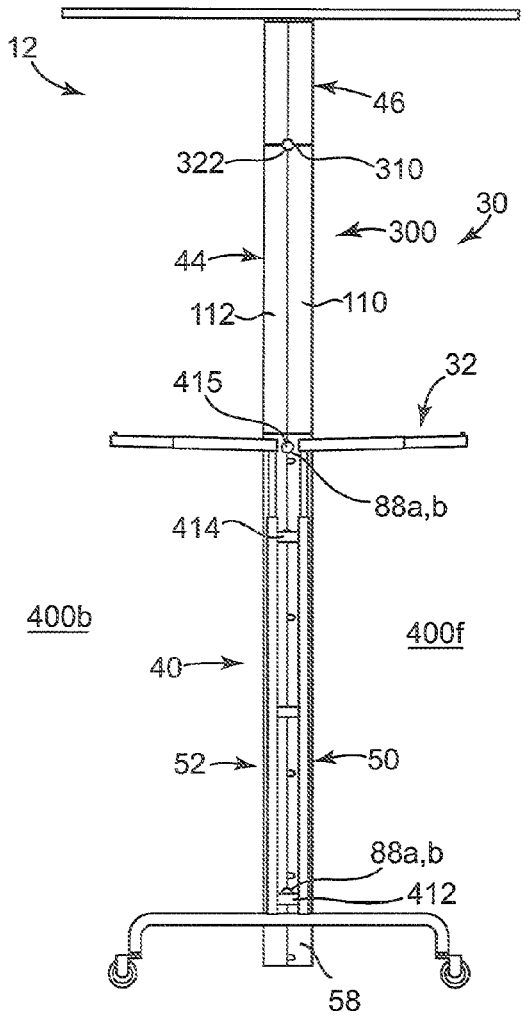
FIG. 18 is a side view of the floor display assembly of FIG. 2 in an assembled state, according to some embodiments.

FIGS. 3, 4, and 5 show the skirt 40, also referred to as a base portion, in an unassembled state from side, bottom, and perspective views, respectively. The skirt 40 optionally includes a first shell 50 and a second shell 52, also described as housing portions. The first and second shells 50, 52 are adapted to be arranged together in a clamshell configuration, where the first and second shells 50, 52 combine to define a substantially hollow, tubular, box-like, and open-ended body 58 (FIG. 18). Some features of the first and second shells 50, 52 are optionally substantially similar and thus are described cumulatively with respect to the first shell 50, where features of the first shell 50 are designated in the description and figures with a reference number and an "a" while corresponding features of the second shell 52 are designated as appropriate with the same reference number and a "b."

Various parts of the first shell 50 are optionally formed of a molded, substantially rigid polymeric material, such as polystyrene or structural foams, for example, although a variety of materials and forming methods are suitable according to design. In some embodiments, the first shell 50 is substantially U-shaped in transverse cross-section and includes a body 58*a* forming a central portion 60*a*, a first lip 62*a*, and a second lip 64*a*. The first shell 50 also includes a flange member 66*a* and a rib member 68*a*.

As shown in one or more of the views of FIGS. 3-5, the body 58*a* extends from a bottom 70*a* to a top 72*a* and from a first side 74*a* to a second side 76*a*. In some embodiments, the body 58*a* is formed to be substantially thin-walled, planar, and rectangular, or is otherwise sheet-like in form.

The central portion 60*a* optionally has a substantially horizontal slot 78*a* or a plurality of slots (not shown) that are positioned toward the top 72*a* and formed through the central portion 60*a*. The central portion 60*a* also optionally has a plurality of stops 80*a* that are located toward the top 72*a* and are raised or otherwise project from the surrounding surface of the central portion 60*a*.

The first lip 62*a* is also substantially thin-walled, planar, and rectangular, or is otherwise sheet-like in form. In some embodiments, the first lip 62*a* is formed continuously, as a single piece, with the central portion 60*a*. For example, the first lip 62*a* and the central portion 60*a* are optionally molded or thermoformed by bending a sheet of material to define the central portion 60*a* and the first and/or second lips 62*a*, 64*a*, respectively. In some embodiments, the first lip 62*a* extends substantially orthogonally relative to the central portion 60*a* along the first side 74*a* of the body 58*a* with a round or bend 82*a* formed between the first lip 62*a* and central portion 60*a*. As shown in one or more of the views of FIGS. 3-5, the first lip 62*a* has an inner face 83*a*, a plurality of semi-circular notches 84*a* (FIG. 5), and a recess 86*a* that correspond to and assist with securing the first shell 50 to portions of the rack fixture assembly 32 (FIG. 2).

The second lip 64*a* is substantially similar to the first lip 62*a* and extends substantially orthogonally from the central portion 60*a* along the second side 76*a*. The second lip 64*a* has a plurality of semi-circular notches 88*a* and a recess 90*a*. The second lip 64*a* also has a plurality of fastener holes 92*a*.

The flange member 66*a* includes a bottom portion 94*a*, a middle portion 96*a*, and a top portion 98*a*, each of which is secured to the inner face 83*a* of the first lip 62*a*. The flange member 66*a* is partially exposed from the first lip 62*a* such that the exposed portion(s) of the flange member 66*a* are able to be secured to the second shell 52. The flange member 66*a* also has a plurality of fastener holes 100*a*. The flange member 66*a* optionally acts as an assembly guide and fastener surface when the first and second shells 50, 52 are engaged together in a clamshell configuration.

The rib member 68*a* is substantially T-shaped in transverse cross section and is secured behind the substantially horizontal slot 78*a*. The substantially horizontal slot 78*a* provides one or more attachment points for various types of fixture accessories (shelves, for example) and the rib member 68*a* reinforces the material around the slot 78*a* against bending under loaded conditions (e.g., when shelving is secured to the slot 78*a*).

As generally shown by a large arrow in FIG. 5, the first and second shells 50, 52 are adapted to be brought together in a complementary, clamshell fit. The shells 50, 52 are optionally fastened together using releasable fastening means 102 (FIG. 4), such as: plastic rivets or fasteners, including those sold under the trade name "CANOE CLIPS" or "CHRISTMAS TREE CLIPS," by Fastex of Illinois or similar fasteners sold by FFr of Ohio. Other releasable fastening means, such as friction fits or tacky adhesives or more permanent fastening means, such as appropriate adhesives or thermal welds, for example, are also contemplated.

As shown in FIG. 2, the chimney 44, also referred to as a stack portion, includes a first housing 110 and a second housing 112, also described as shells, channel members or, in general terms, halves. The first and second housings 110, 112 are adapted to be arranged together in a clamshell configuration, such that the first and second housings 100, 112 combine to define a substantially hollow, tubular, box-like, and open-ended body 120. Some features of the first and second housings 110, 112 are optionally substantially similar and thus are described cumulatively with respect to the first housing 110, where features of the housing 110 are designated in the description and figures with a reference number and an "a" while corresponding features of the second housing 112 are designated as appropriate with the same reference number and a "b."

Figure 6:
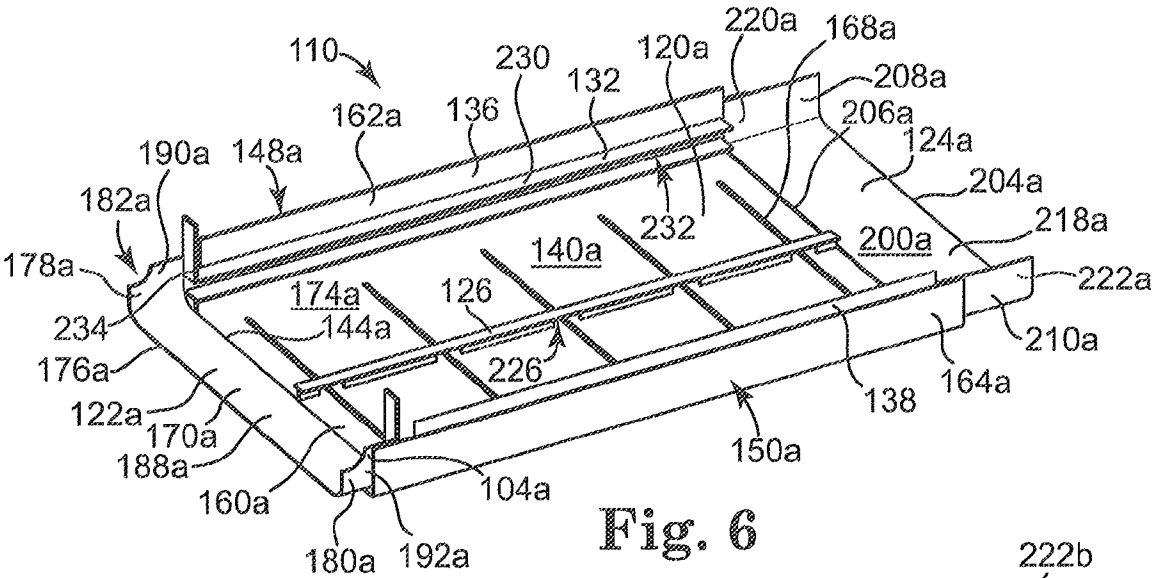
FIG. 6 is a perspective view of a first shell of the skirt of FIG. 3, according to some embodiments.

Various parts of the first housing 110 are optionally formed of a molded, substantially rigid polymeric material, such as polystyrene or structural foams, for example, although a variety of materials, forming methods, and combinations thereof are suitable according to design. FIG. 6 is a perspective view of the first housing 110. As shown, the first housing 110 is optionally substantially U-shaped overall in cross-section and includes a body 120*a*, a lower insert 122*a*, an upper insert 124*a*, a first reinforcement member 126, a first channel 132, a second channel 134 (FIG. 10), a first flange 136, and a second flange 138.

The body 120*a* has an inner surface 140*a*, an outer surface 142*a* (FIG. 9), a top 144*a* (FIG. 9), a bottom 146*a* (FIG. 9), a first side 148*a*, and a second side 150*a* and forms a central portion 160*a*, as well as a first lip 162*a* and a second lip 164*a* along the first and second sides 148*a*, 150*a* of the body 120*a*, respectively. The first and second lips 162*a*, 164*a* curve inwardly from the central portion 160*a*, ultimately extending substantially orthogonally relative to the central portion 160*a*. As shown, the central portion 160*a* of the body 120*a* has a plurality slots 168*a* that are formed through the body

120*a*, from the inner surface 140*a* to the outer surface 142*a*, and which extend substantially horizontally, or crosswise from first side 148*a* toward second side 150*a*, across the central portion 160*a*.

The lower insert 122*a* has an inner surface 170*a*, an outer surface 172*a* (FIG. 9), a top 174*a*, a bottom 176*a*, a first side 178*a*, a second side 180*a*, and first and second cut-outs 182*a*, 184*a* that are substantially quarter-circle shaped. The lower insert 122*a* forms a central portion 188*a*, as well as a first lip 190*a* and a second lip 192*a* along the first and second sides 178*a*, 180*a* of the lower insert 122*a*, respectively. The first and second lips 190*a*, 192*a* curve inwardly from the central portion 188*a*, ultimately extending substantially orthogonally relative to the central portion 188*a*. As shown, the lower insert 122*a* is assembled to the body 120*a* by securing the lower insert 122*a* against the inner surface 140*a* of the body 120*a* with the first and second lips 190*a*, 192*a* of the lower insert 122*a* and against at least a portion of the first and second lips 162*a*, 164*a*, respectively, of the body 120*a*. Upon assembly, a portion of the lower insert 122*a* projects from the bottom 146*a* (FIG. 9) of the body 120*a*.

Figure 9:
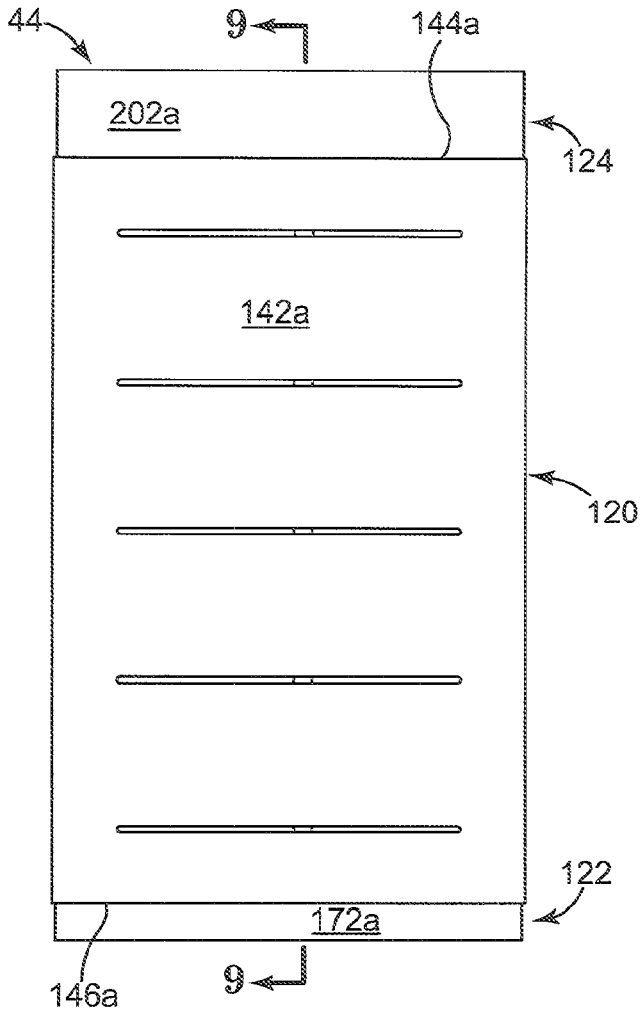
FIG. 9 is a front view of the chimney of FIG. 8, according to some embodiments.

The upper insert 124*a* has an inner surface 200*a*, an outer surface 202*a* (FIG. 9), a top 204*a*, a bottom 206*a*, a first side 208*a*, and a second side 210*a*. The upper insert 124*a* forms a central portion 218*a*, as well as a first lip 220*a* and a second lip 222*a* along the first and second sides 208*a*, 210*a* of the upper insert 124*a*, respectively. The first and second lips 220*a*, 222*a* curve inwardly from the central portion 218*a*, ultimately extending substantially orthogonally relative to the central portion 218*a*. As shown, the upper insert 124*a* is assembled to the body 120*a* by securing the upper insert 124*a* against the inner surface 140*a* of the body 120*a* with the first and second lips 220*a*, 222*a* of the upper insert 124*a* and against at least a portion of the first and second lips 162*a*, 164*a*, respectively, of the body 120*a*. As best seen in FIG. 9, a portion of the upper insert 124*a* projects from the top 144*a* of the body 120*a* upon assembly.

As shown in FIG. 6, the first reinforcement member 126 is substantially T-shaped in transverse cross-section and has a plurality of gaps 226*a*. The first reinforcement member 126 is secured to the inner surface 140*a* of the body 120*a* with the gaps 226 generally aligned to the slots 168*a*. The slots 168*a* provide attachment points for various types of fixture accessories (shelves, for example) and the first reinforcement member 126 reinforces the material around the slots 168*a* against bending under load conditions.

The first channel 132 is substantially elongate and includes a track portion 230 that in combination with the first lip 162*a* defines a longitudinal track 232 extending from the lower insert 122*a* to the upper insert 124*a* along the body 120*a*. The first channel 132 also includes a foot portion 234 that projects substantially orthogonally from the track portion 230, where the foot portion 234 is positioned toward the bottom 146*a* of the body 120*a*.

The second channel 134 (FIG. 10) is obscured in FIG. 6 and is optionally substantially similar to the first channel 132, where the second channel 134 includes a track portion that in combination with the second lip 164*a* defines a longitudinal track 240 (FIG. 10) extending from the top 144*a* to the bottom 146*a* of the body 120*a*. Similarly to the first channel 132, the second channel 134 also optionally includes a foot portion 242 (FIG. 10) that projects substantially orthogonally from the track portion (not shown) at the bottom 146*a* of the body 120*a*.

The first and second flanges 136, 138 are substantially flat members secured to the inner surface 140*a* of the body 120*a* at the first and second lips 162*a*, 164*a*, respectively. As shown, the first and second flanges 136, 138 extend past the first and second lips 162*a*, 164*a* in a direction opposite the inner surface 140*a* and are optionally used to assist in securing the first and second housings 110, 112 together.

Figure 7:
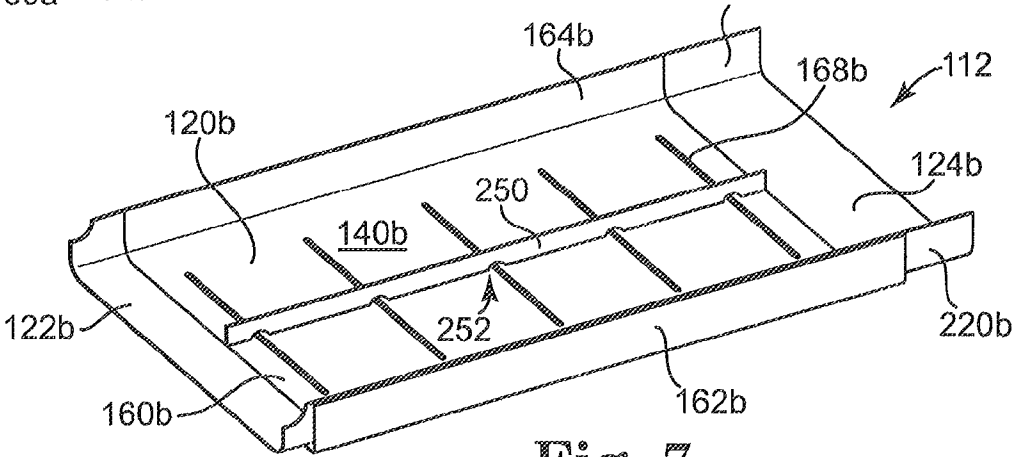
FIG. 7 is a perspective view of a second shell of the skirt of FIG. 3, according to some embodiments.

As previously referenced, various features of the second housing 112 are optionally substantially similar to the first housing 110. For example, the second housing 112 as shown in FIG. 7 includes a body 120*b* having a central portion 160*b*, a first lip 162*b*, and a second lip 164*b*, a lower insert 122*b*, and an upper insert 124*b*, each of those features being substantially similar to those of the first housing 110. The second housing 112 also includes a second reinforcement member 250 described in greater detail below.

The second reinforcement member 250 is a substantially thin, elongate bar of material and includes a plurality of semi-circular cut-outs 252, or gaps, along a length of the second reinforcement member 250. As shown in FIG. 7, the second reinforcement member 250 is secured to an inner surface 140*b* of the body 120*b* with the cut-outs 252 facing the inner surface 140*b* and being located opposite a plurality of slots 168*b* formed through the body 120*b*. As with the first reinforcement member 126 of the first housing 110, the second reinforcement member 250 provides reinforcement for the slots 168*b*, which, in turn, provide attachment points for various types of fixture accessories (peg hooks or shelves, for example). In particular, the second reinforcement member 250 reinforces the material around the slots 168*b* against bending under load conditions.

Figure 8:
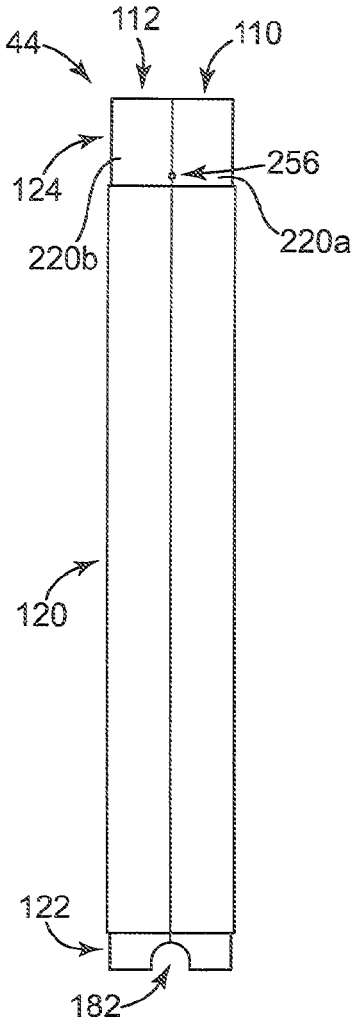
FIG. 8 is a side view of a chimney of the floor display assembly of FIG. 2, according to some embodiments.
Figure 10:
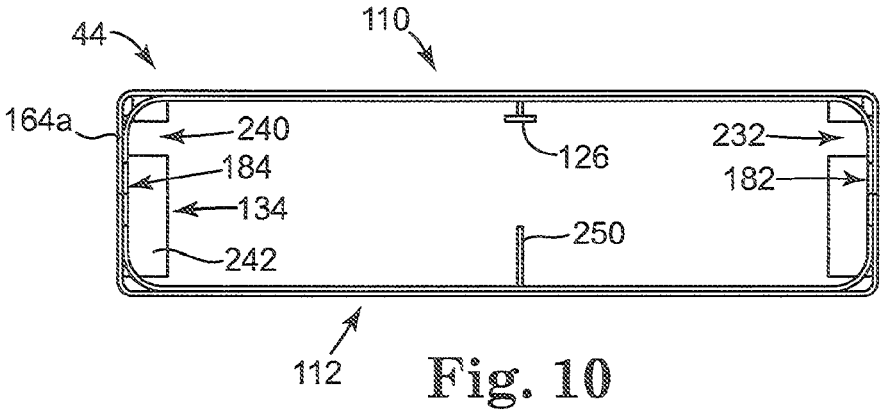
FIG. 10 is a bottom view of the chimney of FIG. 8, according to some embodiments.

The first and second housings 110, 112 are optionally releasably secured together or are secured together more permanently, for example via welds or adhesives. FIGS. 8-10 show the complementary, clamshell fit of the first and second housings 110, 112 as assembled, where FIG. 8 is a side view, FIG. 9 is a front view, and FIG. 10 is a bottom view thereof. With reference from FIGS. 6 and 7 to FIGS. 8-10, the first and second housings 110, 112 are optionally assembled with the inner surfaces 140*a*, 140*b* facing one another to define the open, tubular form of the chimney 44. The first and second flanges 136*a*, 138*a* of the first housing 110 are received against the first and second lips 162*b*, 164*b* of the second housing 112 with the lower inserts 122*a*, 122*b* aligned to one another and upper inserts 124*a*, 124*b* aligned to one another.

Upon assembly, the housings 110, 112 combine to define a combined body 120, a lower insert 122, and an upper insert 124, where the lower insert 122 has a semi-circular cut-out 182 and a semi-circular cut-out 184. In turn, the upper insert 124 has a hole 256 corresponding to the first lips 220*a*, 220*b* and optionally has a second hole (not shown) that is similarly positioned on the second lips 222*a*, 222*b*. The first hole 256 and the second hole are adapted to receive fastening means, including any of those described herein, such as plastic rivets or fasteners, including those sold under the trade name "CANOE CLIPS" or "CHRISTMAS TREE CLIPS," by Fastex of Illinois or similar fasteners sold by FFr ("Fasteners for Retail") of Ohio.

As shown in FIG. 2, the light treatment assembly 46, also described as light filtering means, or light filter, includes a plume 300, a ring assembly 302, and a lens assembly 304. In general terms, the light treatment assembly 46 is adapted to pass at least some ambient lighting and to modify the ambient lighting. The light treatment assembly 46 is also adapted to present graphics or other indicia to consumers as desired. The various parts of the light treatment assembly 46 are optionally formed of molded, substantially rigid polymeric materials, such as polystyrenes or structural foams, although a variety materials and forming methods are contemplated.

Figure 11:
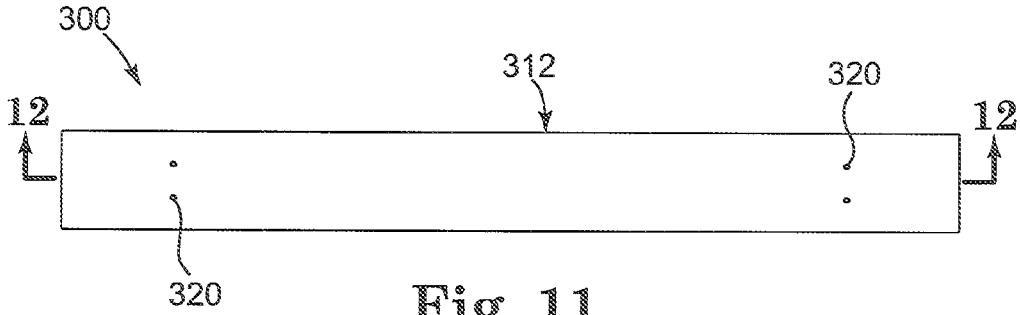
FIG. 11 is a top view of a plume of the floor display assembly of FIG. 2, according to some embodiments.
Figure 12:
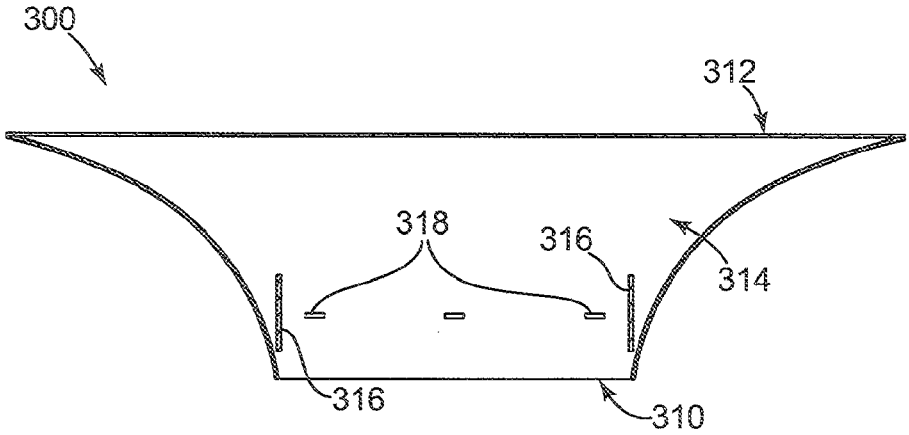
FIG. 12 is cross-sectional view of the plume of FIG. 11, according to some embodiments.
Figure 13:
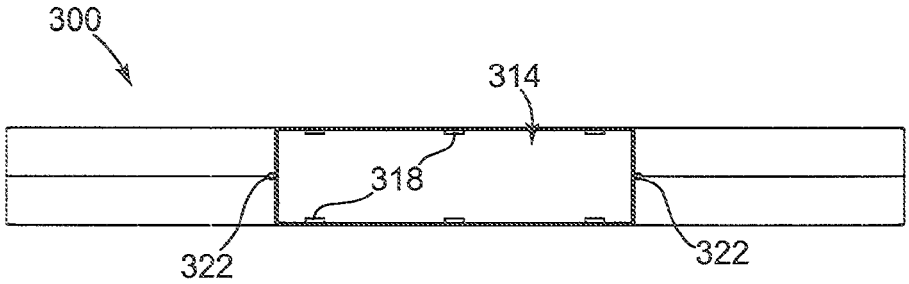
FIG. 13 is a bottom view of the plume of FIG. 11, according to some embodiments.

FIG. 11 shows the plume 300 from a top view; FIG. 12 shows the plume 300 in cross-section taken along line 12-12 of FIG. 11; and FIG. 13 shows the plume 300 from a bottom view. As shown, the plume 300, also described as a base portion of the light treatment assembly 46, has a bottom 310, a top 312 and an interior 314 and forms inner guides 316 and a plurality of stops 318. The bottom 310 is optionally open and substantially square in shape. In turn, the top 312 is optionally closed, substantially square in shape, and has a plurality of fastener holes 320. As best shown in FIG. 12, the plume 300 tapers down in width from the top 312 to the bottom 310. As shown in FIG. 13, opposing fastener holes 322 are formed toward the bottom 310 of the plume 300. Similarly to other components described above, the plume 300 is optionally formed of complementary housings or shells that are permanently or releasably secured to one another, although monolithic constructions are employed as appropriate.

Figure 14:
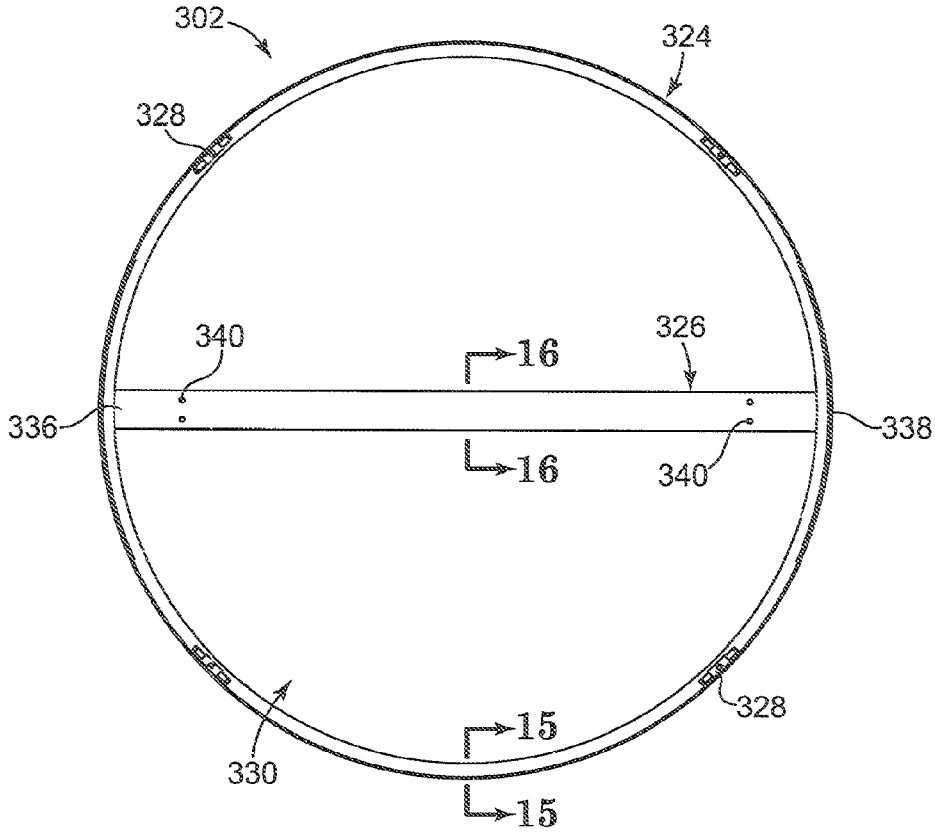
FIG. 14 is a top view of a ring assembly of the floor display assembly of FIG. 2, according to some embodiments.

FIG. 14 shows the ring assembly 302 from a top view. As shown, the ring assembly 302, also described as a ring portion of the light treatment assembly 46, includes a support ring 324 and a cross-member 326. In some embodiments, the ring assembly 302 also includes a plurality of spring clips 328 which are optionally similar to those subsequently described in association with the ceiling display assemblies 16.

Figure 15:
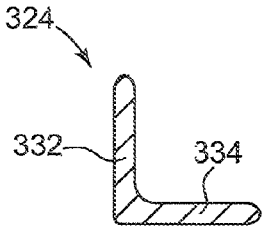
FIG. 15 is a cross-section of a support ring of the ring assembly of FIG. 14, according to some embodiments.

As shown in FIG. 14, the support ring 324 is substantially circular and has an open interior 330. FIG. 15 shows a portion of the support ring 324 in cross-section along line 15-15 of FIG. 14. As shown, the support ring 324 is optionally substantially L-shaped in cross-section, the support ring 324 defining an outer wall 332 and a support lip 334, where the outer wall 332 and the support lip 334 are optionally substantially orthogonal.

Figure 16:
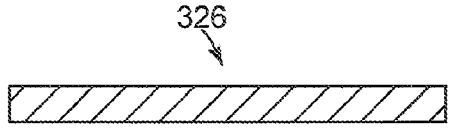
FIG. 16 is a cross-section of a cross-member of the ring assembly of FIG. 14, according to some embodiments.

In some embodiments, the cross-member 326 extends from a first end 336 to a second end 338. The cross-member 326 also includes a plurality of fastener holes 340. Each of the first and second ends 336, 338 are attached to the support ring 324 such that the cross-member 326 bisects the open interior 330 of the support ring 324. FIG. 16 shows a portion of the cross-member 326 in cross-section along line 16-16 of FIG. 14. As shown, the cross-member 326 is optionally substantially rectangular in transverse cross-section, although other shapes are optionally employed.

As shown in FIG. 2, the lens assembly 304, or light filtering means, optionally includes a lens portion 350 and an indicia portion 352, although in some embodiments, the lens portion 350 includes indicia (not shown) and serves additionally or alternatively as the indicia portion 352. In some other embodiments, the lens portion 350 is permanently fixed to the ring assembly 302 and the indicia portion 350 is used as a removable feature that is easily swapped out to change light and indicia effects.

With the foregoing in mind, the lens portion 350 optionally includes first and second panel halves 350*a*, 350*b*, although unitary, or monolithic, forms are also contemplated. Each of the panel halves 350*a*, 350*b* is a substantially thin and optically translucent sheet of material. The panel halves 350*a*, 350*b* have any of a variety of translucencies, from substantially clear or transparent, to nearly opaque, for example. In some embodiments, one or both of the first and second panel halves 350*a*, 350*b* includes lenticular surface(s), flat surface (s), optical coatings, colorings, or other surface treatments to vary the appearance of light passing through the lens portion 350. The lens portion 350 optionally includes a plurality of fastener holes 356 for securing the lens portion 350 to the ring assembly 302.

The indicia portion 352 as shown is a substantially round, monolithic panel, although other forms of the indicia portion 352 (e.g., indicia portions having first and second panel halves) are also contemplated. The indicia portion 352 includes indicia 358, such as graphics, lettering, or other information conveying markings. The indicia portion 352 is optionally a substantially thin and optically translucent sheet of material having any of a variety of translucencies—from substantially clear or transparent, to nearly opaque, for example. In some embodiments, the indicia portion 352 includes one or more lenticular surfaces, flat surfaces, optical coatings, colorings, or other surface treatments to vary the appearance of light passing through the indicia portion 352. The indicia portion 352 also optionally includes a plurality of fastener holes (not shown) for securing the indicia portion 352 to the ring assembly 302.

The light treatment assembly 46 is assembled by aligning the top 312 of the plume 300 to the bottom of the cross-member 326 of the ring assembly 302. In turn, the lens portion 350 is received on top of the support lip 334 of the ring assembly 302 and on top of the cross-member 326. The lens portion 350, the cross-member 326, and the top 312 of the plume 300 are then secured together using a plurality of fasteners, such as CANOE CLIPS or other fastening means described herein, inserted into the fastener holes 320, 340, 356. Additionally, the indicia portion 352 optionally rests atop the lens portion 350 or is secured thereto, for example using any of the fastening means described herein, though the positions of the indicia portion 352 and lens portion 350 are optionally switched.

Figure 17:
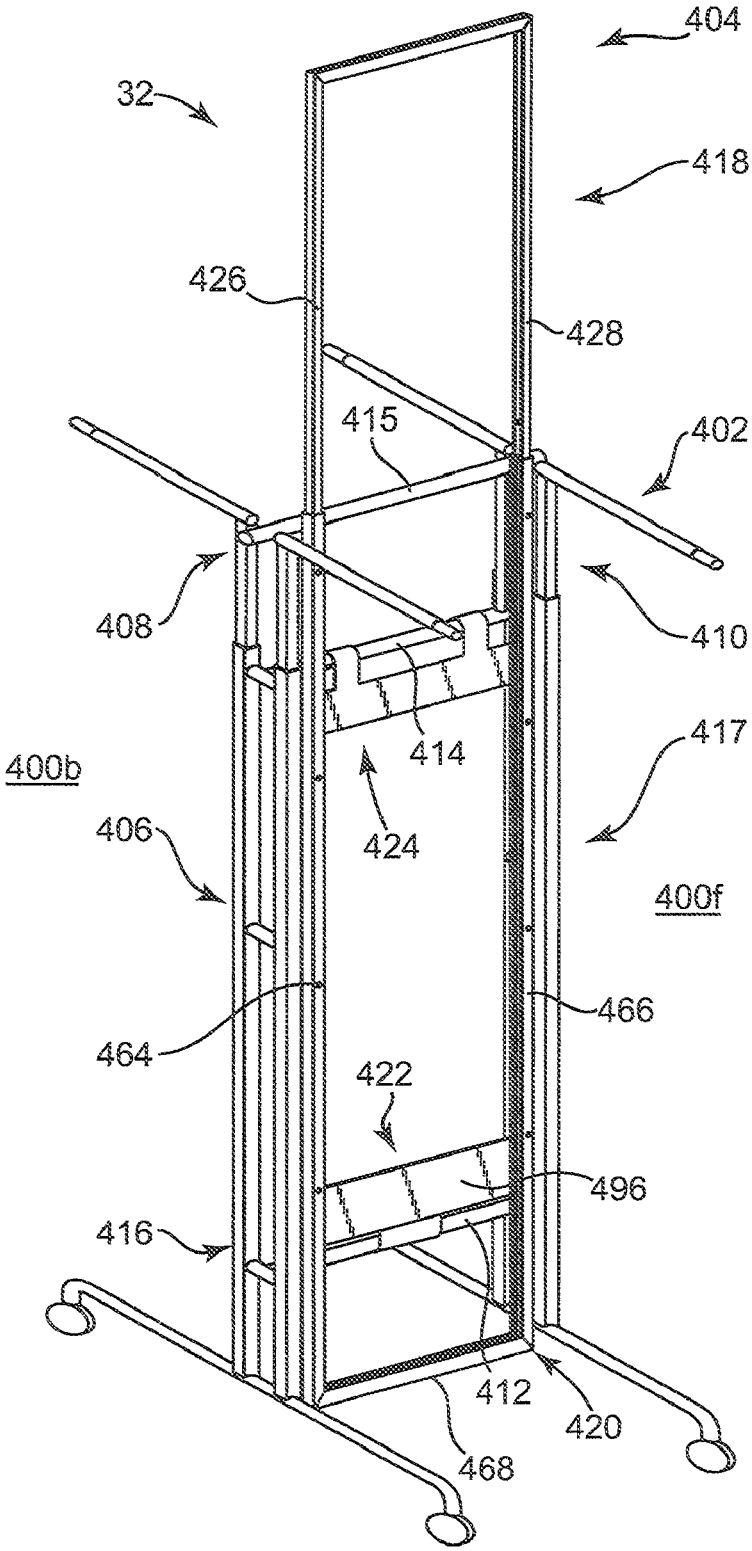
FIG. 17 is a perspective view of a rack fixture assembly of the floor display assembly of FIG. 2, according to some embodiments.

FIG. 17 shows the rack fixture assembly 32 from a perspective view from a front side 400*f* of the assembly 32. The rack fixture assembly 32 is also described as a fixture assembly, or a rack assembly. The rack fixture assembly 32 defines the front side 400*f*, as well as a back side 400*b*, and includes a quad-rack fixture 402, also described as a stand, a base fixture, or a rack. The rack fixture assembly 32 also includes a frame assembly 404, also described as a mounting frame, a billboard attachment, a billboard attachment, or a billboard extender. The frame assembly 404 is adapted to be extendable to receive display pieces, such as signs, billboards, or other display pieces.

The quad-rack fixture 402 includes a plurality of tubular members forming a first extendable arm assembly 408, a second extendable arm assembly 410, a lower cross-member 412, an intermediate cross-member 414, a top cross-member 415, a first end piece 416 and a second end piece 417. The extendable arm assemblies 408, 410 are optionally adapted for supporting or otherwise maintaining clothes, hangers, etc. The first and second end pieces 416, 417 are adapted to support the quad rack fixture 402 on a substantially horizontal surface (not shown), where the quad-rack fixture 402 is adapted for displaying merchandise, for example clothing maintained on hangers.

The extendable frame assembly 404 includes a telescoping frame 418, a base frame 420, a lower clip assembly 422, and an upper clip assembly 424. The extendable frame assembly 404 is supported in a substantially vertical position by the quad-rack fixture 402 and optionally extends vertically above the quad-rack fixture 402. The frame assembly 404 is capable of receiving display pieces of various sizes and/or multiple display pieces.

The base frame 420 includes a first vertical leg 464, a second vertical leg 466, and an end member 468 extending between the first and second vertical legs 464, 466. In turn, the telescoping frame 418 is slidably received within the base frame 420 to allow height/size adjustment of the extendable frame assembly 404. In particular, the telescoping frame includes a first vertical slide member 426 that is inserted into the first vertical leg 464 and a second vertical slide member 428 that is inserted into the second vertical leg 466 such that the telescoping frame 418 is slidable vertically relative to the base frame 420. Examples of suitable rack fixture assemblies are described in U.S. Pat. App. Pub. No. 2007/0170139, filed Jan. 25, 2007 and entitled "Display Fixture Accessories," the entire contents of which are incorporated herein.

An assembled version of the floor display assembly 12 is shown in FIG. 18 from a side view. With reference between the exploded view of FIG. 2 and the assembled view of FIG. 18, assembly of the floor display assembly 12 optionally includes positioning the first shell 50 of the skirt 40 on the front side 400*f* of the rack fixture assembly 32 and the second shell 52 on the back side 400*b* of the rack fixture assembly 32. The first and second shells 50, 52 are brought together such that the plurality of semi-circular notches 88*a*, 88*b* of the first and second shells 50, 52 line up with the cross-members 412, 414, 415 of rack fixture assembly 32 and the recesses 90*a*, 90*b* line up with the end member 468 of the retail fixture assembly 32. The fastening means 102 (FIG. 4) are then secured into the fastener holes 92*a*, 100*b* and 92*b*, 100*a* (FIG. 5), respectively, to help releasably secure the skirt 40 together.

In some embodiments, the chimney 44 is optionally provided pre-assembled, in a substantially permanent form or is otherwise provided to an assembler (not shown). In some embodiments, the first and second housings 110, 112 of the chimney 44 are brought together by the assembler and are secured together as previously described. The chimney 44 is optionally mounted over the portion of the extendable frame assembly 404 exposed from the skirt 40 by sliding the first and second channels 132, 134 (FIG. 10) over the first and second slide members 426, 428 of the retail fixture assembly 32 such that the extendable frame assembly 404 is received in the tracks 232, 240 of the chimney 44. The chimney 44 is optionally slid downwardly such that the chimney 44 rests atop the skirt 40 with the lower insert 122 being slid into the skirt 40 until lower insert 122 abuts the stops 80*a*, 80*b* (FIG. 4) of the skirt 40 and the semi-circular cut-outs 182, 184 (FIG. 10) abut or are otherwise received over the top cross-member 415. As understood with reference to FIG. 18, the chimney 44 and the skirt 40 have substantially similar transverse outer perimeters where they meet, such that the chimney 44 and the skirt 40 fluidly transition into one another upon assembly.

The light treatment assembly 46 is assembled to the chimney 44 by sliding the bottom 310 of the plume 300 (FIGS. 11-13) down over the upper insert 124 the chimney 44 until the bottom 310 of the plume 300 rests against the tops 144*a*, 144*b* of the chimney housings 110, 112 and/or until the top 204 of the upper insert 124 abuts the stops 318 (FIG. 12) of the plume 300. In some embodiments, the inner guides 316 (FIG. 12) of the plume 300 slide against the upper insert 124 to assist in correctly positioning the light treatment assembly 46 on the chimney 44. If desired, fastening means, such as those previously described, are optionally inserted into the holes 256 of the upper insert 124 (FIG. 8) and the holes 322 in the plume 300 to secure the chimney 44 and light treatment assembly 46 together.

Figure 19:
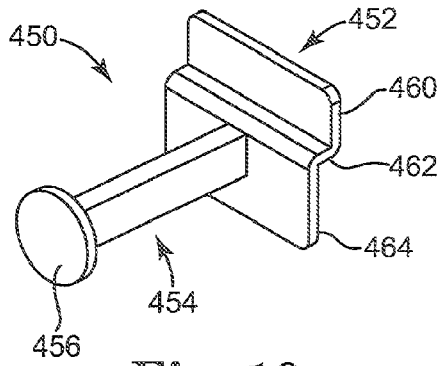
FIG. 19 is a perspective view of a peg hook, according to some embodiment.

FIG. 19 shows a peg hook 450, or slot mounted peg, which is one type of slot-mountable fixture accessory used with the floor display assembly 12. As shown, the peg hook 450 includes a bracket 452, a body 454, and an end stop 456. The bracket 452 includes an upper portion 460, a step portion 462, and a lower portion 464. The bracket 452 is adapted to be secured to the cover 30 (FIGS. 2 and 18) using one of the slots 78, 168, for example. The upper portion 460 is substantially upright, the step portion 462 extends substantially orthogonally from the upper portion 460, and the lower portion 464 extends substantially orthogonally to the step portion 462 such that is substantially parallel with, and offset from, the upper portion 460.

In some embodiments, the upper portion 460 is inserted into one of the slots 78, 168 and the lower portion 464 is pivoted downwardly such that the step portion 462 rests on material defining a bottom edge of a particular slot with the upper portion 460 residing inside the cover 30 and resting against an inner surface of the cover 30 (e.g., inner surface 140*a*) and the lower portion 464 resting against an outer surface of the cover 30 (e.g., outer surface 142*a*). The body 454 is optionally adapted to support clothing hangers, with the end stop 456 helping to prevent the clothing hangers from sliding off the body 454. Although the bracket 452 is optionally used in association with a peg hook type design adapted to support clothing hangers, bracket designs similar to the bracket 452 are optionally used with shelving (not shown) or other types of fixture accessories to be secured in the slots 78, 168. In view of the foregoing, the cover 30 optionally provides means for augmenting the attachment points and/or to adapt the rack fixture assembly 32 for use with different types of fixture accessories, such as the peg hook 450.

As shown in FIG. 1, the ceiling display assemblies 16, also described as ceiling displays, optionally include a first ceiling display assembly 16*a*, a second ceiling display assembly 16*b*, and a third ceiling display assembly 16*c*. Some features of the ceiling display assemblies 16 are optionally substantially similar and thus are described cumulatively with respect to the first ceiling display assembly 16*a*, where features of the first ceiling display assembly 16*a* are designated in the description and figures with a reference number and an "a" while corresponding features of the second ceiling display assembly 16*b* are called out as appropriate with the same reference number and a "b" and corresponding features of the second ceiling display assembly 16*c* are called out as appropriate with the same reference number and a "c."

Figure 20:
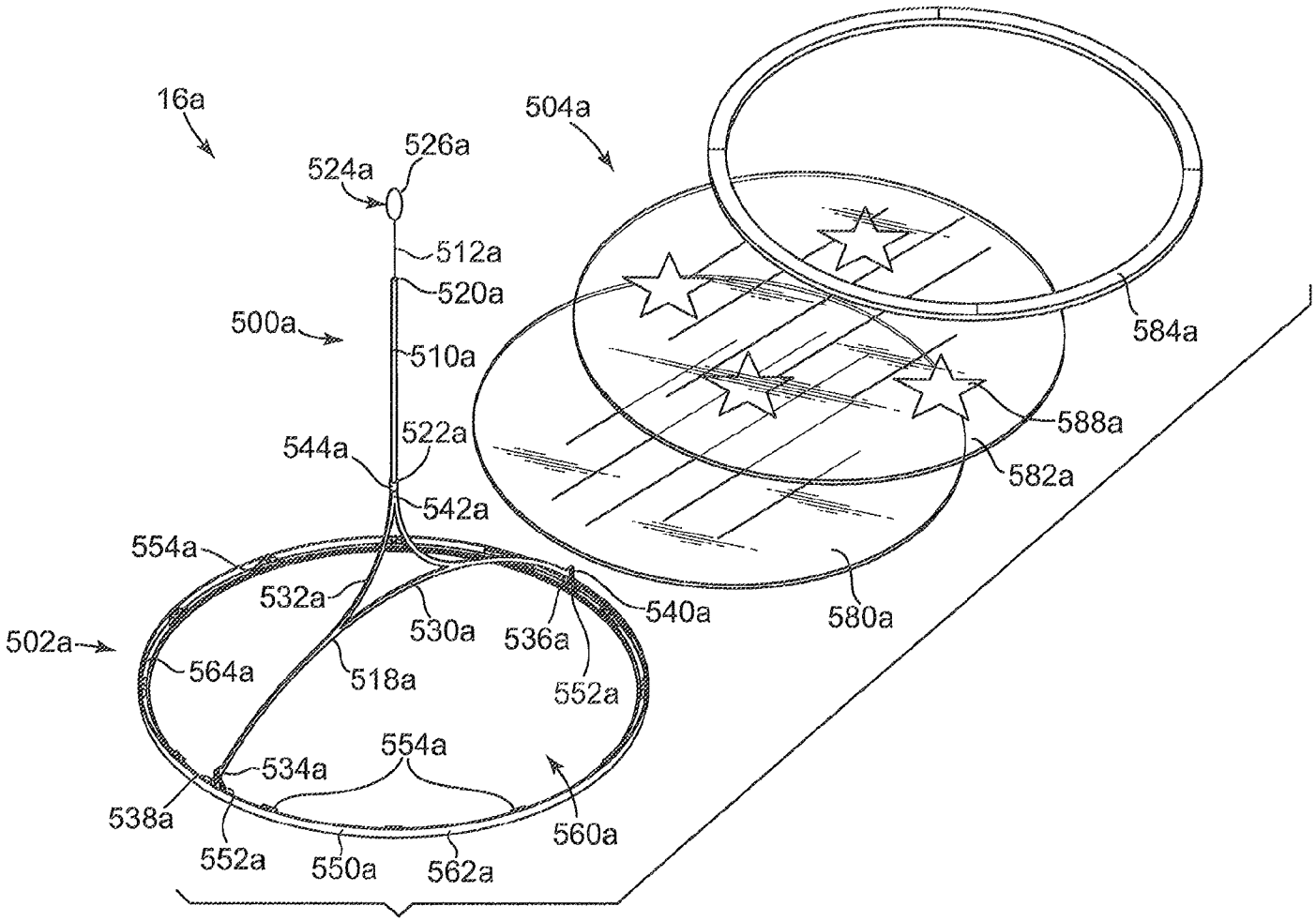
FIG. 20 is an exploded view of a ceiling display assembly of the display system of FIG. 1, according to some embodiments.

FIG. 20 shows the first ceiling display assembly 16*a* in a partially assembled state. As shown, the first ceiling display assembly 16*a* includes a hanger assembly 500*a*, a support ring assembly 502*a*, and a lens assembly 504*a*. In general terms, the first ceiling display assembly 16*a* is adapted to modify ambient lighting and to present graphics or other indicia to consumers. The various parts of the first ceiling assembly 16*a* are formed of molded polymeric materials and welded metal, such as polystyrenes, structural foams, and/or aluminum, although a variety materials and forming methods are contemplated.

As shown, the hanger assembly 500 includes a tubular body 510*a*, an inner member 512*a*, and a cross-beam 518*a*. The tubular body 510*a* is elongate and hollow and extends from a first end 520*a* to a second end 522*a*. The inner member 512*a* is optionally formed of wire material and has a first end 524*a* forming a loop 526*a* and extends through the tubular body 510*a* to a second end (not shown) that is secured to the cross-beam 518*a*. The cross-beam 518 includes a lower arch portion 530*a* and an upper arch portion 532*a*. The lower arch portion 530*a* is an arcuate body that arches downwardly, extending between a first end 534*a* and a second end 536*a*, each of the ends 534*a*, 536*a* having a hook 538*a*, 540*a*, respectively. The hooks 538*a*, 540*a* are open or closed hooks as desired. The upper arch portion 532*a* includes upwardly curved arcuate bodies that extend from the lower arch portion 530*a*, arching fluidly upward to a connector point 542*a*. The connector point 542*a* includes a collar 544*a* adapted to receive the second end 522*a* of the tubular body 510*a* and an inner eyelet (not shown) to which the second end (not shown) of the inner member beam 512*a* is secured.

The support ring assembly 502*a* includes a support ring 550*a*, or mounting ring, a pair of connector loops 552*a*, and a plurality of spring clips 554*a*.

The support ring 550*a* is substantially circular and has an open interior 560*a*. The support ring 550*a* is optionally substantially L-shaped in cross-section, the support ring 550*a* defining an outer wall 562*a* and a support lip 564*a*. The support ring 550*a*, as well as other portions of the assembly 502*a*, is optionally formed of plastic or metal materials as desired.

The connector loops 552*a* are C-shaped and are attached to the outer wall 562*a* on opposite sides of the support ring 550*a*. The connector loops 552*a* are adapted to assist in securing the support ring assembly 502*a* to the hanger assembly 500*a* by receiving the hooks 538*a*, 540*a* of the hanger assembly 500*a*.

Figure 21:
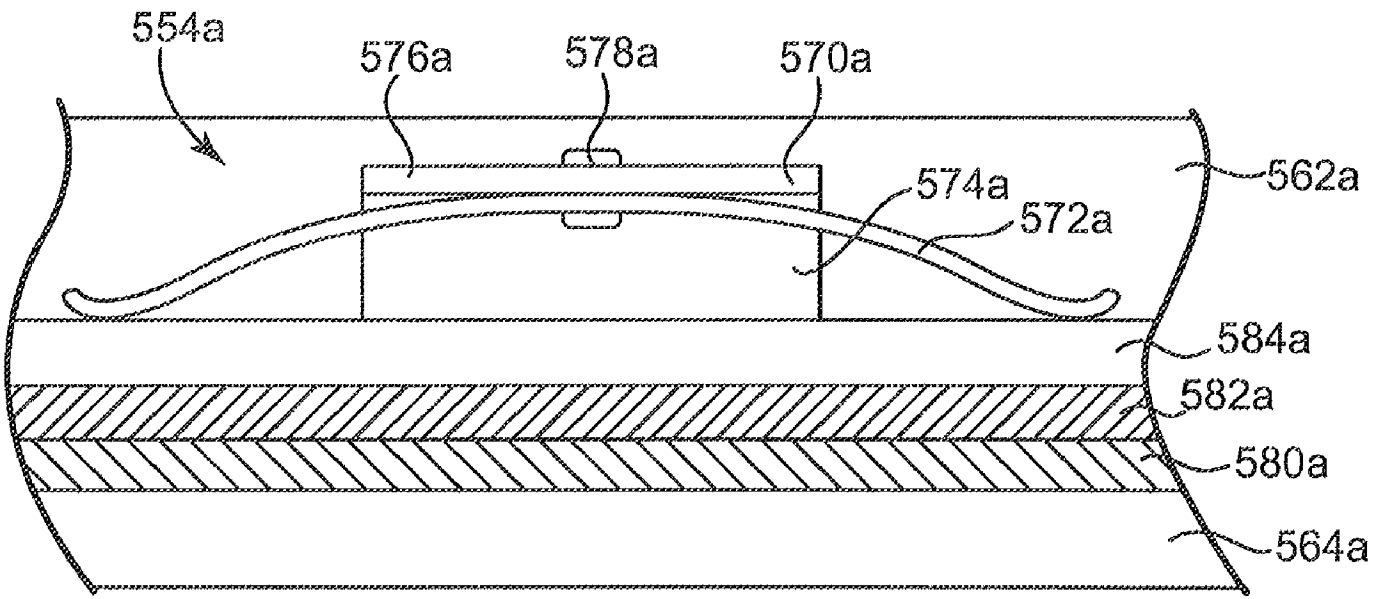
FIG. 21 is a partial cross-section of the ceiling display assembly of FIG. 20, according to some embodiments.

A first one of the plurality of spring clips 554*a* is shown in FIG. 21, with the remaining spring clips 554*a* being substantially similar as desired. As shown, the spring clip 554*a* includes a bracket 570*a* and a recurved spring body 572*a*. The bracket 570*a* is substantially L-shaped and includes a substantially vertical body 574*a* and a top piece 576*a* that extends orthogonally from the substantially vertical body 574*a*. The recurved spring body 572*a* is secured to the top piece 576*a*, for example with a rivet 578*a* or other fastener.

As shown in FIG. 20, in some embodiments, the lens assembly 504*a* includes a lens panel 580*a*, an indicia panel 582*a*, and a spacer ring 584*a*. The lens panel 580*a* is optionally a substantially thin and optically translucent sheet of material. The lens panel 580*a* has any of a variety of translucencies, from substantially clear or transparent, to nearly opaque, for example. In some embodiments, the lens panel 580*a* includes lenticular surface(s), flat surface(s), optical coatings, colorings, or other surface treatments to vary the appearance of light passing through the lens panel 580*a*.

The indicia panel 582*a* optionally includes indicia 588*a*, such as graphics, lettering, or other information conveying markings. The indicia panel 582*a* is optionally a substantially thin and optically translucent sheet of material and has any of a variety of translucencies, from substantially clear or transparent, to nearly opaque, for example. In some embodiments, the indicia panel 582*a* includes lenticular surface(s), flat surface(s), optical coatings, colorings, or other surface treatments to vary the appearance of light passing through the indicia panel 582*a*.

The spacer ring 584*a* is optionally formed of compliant material, such as a polymeric foam, and is optionally a monolithic piece or comprised of several pieces as shown in FIG. 20. The spacer ring 584*a* is adapted to rest on top of the lens panel 580*a* and indicia panel 582*a* and is generally sized to the support lip 564*a* of the support ring 550*a*. In some embodiments, the spacer ring 584*a* acts to protect the lens panel 580*a* and indicia panel 582*a* and takes up some nonconformities and other irregularities in the spacer ring-indicia panel-lens panel assembly, as described in greater detail below.

FIG. 21 shows an assembly of the lens assembly 504*a* into the support ring assembly 502*a* according to some embodiments. The lens panel 580*a* and indicia panel 582*a* are positioned within the outer wall 562*a* of the support ring 550*a* and rest on top of the support lip 564*a*. The spacer ring 584 is positioned atop the indicia panel 582 and under the spring clips 554*a* where the spring clips 554 are secured to the outer wall 562*a* of the support ring 550*a*. The lens panel 580*a* and indicia panel 582*a* are shown in cross-section in FIG. 21 to allow a better view of the assembly. As shown the lens panel 580*a* is stacked on the support lip 564*a*, the indicia panel 582*a* is stacked on the lens panel 580*a*, and the spacer ring 584*a* is stacked on the indicial panel 582*a* with the spring clip 554*a*, and in particular the recurved spring body 572 biased downwardly against the stacked panels and spacer ring 580*a*, 582*a*, 584*a*. From this it should also be understood that the remainder of the spring clips 554*a* also assist placing a retention force on the stacked components 580*a*, 582*a*, 584*a*.

As shown in FIG. 1, the ceiling display assemblies 16 are optionally hung from the ceiling 18 using any of a variety of hooks, fasteners, or other appropriate hangers. In some embodiments, the ceiling 18 is a suspended ceiling and the ceiling display assemblies 16 are hung from the ceiling 18 using hangers similar to those described in U.S. patent application Ser. No. 12/016,102, filed Jan. 17, 2008, entitled "Ceiling Grid Spanner," the entire contents of which are incorporated herein by reference.

As shown in FIG. 1, methods of retailing, or displaying products, optionally include assembling the floor display assembly 12 by securing the cover 30 to the rack fixture assembly 32 as previously described and hanging the products 20 from the extendable arm assemblies 408, 410 of the rack fixture assembly 32 and or securing the peg hook 450 (shown generally in FIG. 1) to the cover 30, and hanging products 20 from the peg hook 450.

In some embodiments, the floor display assembly 12 is positioned under ambient lighting in a retail area. For example, as shown in FIG. 1, the ceiling 18 includes ceiling lighting 600*a*, 600*b*, 600*c* that each provide ambient lighting 602*a*, 602*b*, 602*c* (designated generally by dotted lines), respectively. In some embodiments, the ceiling lighting 600*a*, 600*b*, 600*c* is fluorescent or incandescent lighting suspended from the ceiling 18. Although the floor display assembly 12 is shown directly under the ceiling lighting 600*b*, with ambient lighting 602*b* designated generally as a vertical column, it should be understood that the floor display assembly 12 need not be positioned directly under the ceiling lighting 600*b* in order to receive the ambient lighting 602*b* and that in addition to the ambient lighting 602*b*, the floor display assembly 12 additionally or alternatively receives ambient lighting from other sources, such as ceiling lighting 600*a*, 600*c*.

In some embodiments, the light treatment assembly 46 of the floor display assembly 12 receives some of the ambient lighting 600*b* and modifies the original appearance of the ambient lighting 602*b*, for example by softening, coloring, and/or filtering the lighting appearance. Additionally, the indicia portion 352 (FIG. 2) of the light treatment assembly 46 is optionally lit up, highlighted, set out, or is otherwise given a lighting effect by the ambient lighting 602*b*. In at least this manner, the light treatment assembly 46 optionally helps provide a visually pleasing, informative, or otherwise visually effective product display to a consumer or other observer.

Methods of displaying additionally or alternatively include hanging one or more of the ceiling display assemblies 16*a*, 16*b*, 16*c* such that they are positioned under ambient lighting in the retail area. For example, as shown in FIG. 1, the ceiling display assemblies 16*a*, 16*b*, 16*c* are each positioned under the ambient lighting 602*a*, 602*b*, 602*c* (designated generally by dotted lines), respectively. Although the ceiling display assemblies 16*a*, 16*b*, 16*c* are shown directly under the ceiling lighting 600*a*, 600*b*, 600*c*, it should be understood that the ceiling display assemblies 16 need not each be positioned directly under the ceiling lighting 600*a*, 600*b*, 600*c*, respectively, in order to receive the ambient lighting 602*a*, 602*b*, 602*c* and that any one or more of the ambient lighting 602*a*, 602*b*, 602*c* are optionally received by one or more of the ceiling display assemblies 16.

As alluded to above, in some embodiments, the ceiling display assemblies 16 receive some of the ambient lighting 602*a*, 602*b*, 602*c* and modify the original appearance of the ambient lighting 602*a*, 602*b*, 602*c*, for example with the lens panels 580*a*, 580*b*, 580*c* (FIG. 20) and/or indicia panels 582*a*, 582*b*, 582*c* (FIG. 20) softening, coloring, and/or filtering the lighting appearance. Additionally, the indicia panel or panels 582*a*, 582*b*, 582*c* of the ceiling display assemblies 16*a*, 16*b*, 16*c*, respectively are optionally lit up, highlighted, set out, or otherwise given a lighting effect by the ambient lighting 602*a*, 602*b*, 602*c*. In at least this manner, the light treatment assembly 46 optionally helps provide a visually pleasing, informative, or otherwise visually effective product display to a consumer or other observer. Furthermore, as shown in FIG. 1, ambient lighting, such as ambient lighting 602*b* is optionally filtered or otherwise modified multiple times, for example with the ceiling display assembly 16*b* first modifying the ambient lighting 602*b* and the floor display assembly 12 further modifying the already modified ambient lighting 602*b*.

In some embodiments, the method of retailing or displaying additionally or alternatively includes positioning the floor display assembly 12 and the ceiling display assemblies 16 to naturally draw consumer attention to a desired area. As shown in FIG. 1, the first and third ceiling display assemblies 16*a*, 16*c* are optionally arranged to define a visual horizon X to an observer, while the second ceiling display assembly 16*b* and the floor display assembly 12 are optionally arranged to define a visual column Y to the observer. In some embodiments, the convergence of the visual horizon X and visual column Y acts to draw the observer's attention centrally to the floor display assembly 12 and upward from the retail floor 14 across the products 20, although a variety of other arrangements that draw the observer's attention to the products 20, or other focal point, are also contemplated.

As shown in FIG. 1, the ceiling display assemblies 16 optionally include a first ceiling display assembly 16*a*, a second ceiling display assembly 16*b*, and a third ceiling display assembly 16*c*. In some embodiments, the first and third ceiling display assemblies 16*a*, 16*c* are optionally arranged to define a visual horizon X to an observer, while the second ceiling display assembly 16*b* and the floor display assembly 12 are optionally arranged to define a visual column Y to the observer. For example, the visual horizon X is defined by the general horizontal alignment, or similarity in height of support rings 550*a*, 550*c* of the ceiling display assemblies 16*a*, 16*c* with that of the support ring 324 of the floor display assembly 12.

In turn, the visual column Y is defined by the general vertical alignment, or similarity in lateral position, as well as substantially parallel orientation, of the support ring 550*b* of the ceiling display assembly 16*b* with the support ring 324 of the floor display assembly 12. As shown, the ceiling display assembly 16*b* is positioned substantially higher off of the floor 14 that assemblies 16*a*, 16*b*. This is optionally accomplished by shortening the tubular body 510*b* and inner member 512*b* of the ceiling display assembly 16*b* relative to those of the ceiling display assemblies 16*a*, 16*c*.

The shape of the plume 300 of the floor display assembly 12 and the cross-beams 518*a*, 518*b*, 518*c* of the ceiling display assemblies 16 optionally augment the definition of the visual horizon X and the visual column Y. In particular, the plume 300 defines an increasing width, or tapers, moving upward toward the ceiling. Thus, the floor display assembly 12 is optionally described as an upward plume. The cross-beams 518*a*, 518*b*, 5158*c* of the ceiling display assemblies 16 define an increasing width, or taper, moving downward toward the floor 14. Thus, the ceiling display assemblies 16 have what is optionally described as downward plumes. These opposite tapers, or plume directions, form a visual contrast that helps define the visual horizon X and the visual column Y. Furthermore, in some embodiments, the convergence of the visual horizon X and visual column Y optionally helps act to draw the observer's attention centrally to the floor display assembly 12 and upward from the retail floor 14 across the products 20, although a variety of other arrangements that draw the observer's attention to the products 20, or define one or more other focal points, are also contemplated. In additional to any variety of positions, it should also be apparent that any number of floor display assemblies and ceiling display assemblies are employed in conjunction with one another as desired.

Various modifications and additions can be made to the embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

In the description, reference is made to the accompanying drawings, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the various embodiments can be positioned in a number of different orientations, the directional terminology is used for the purposes of illustration and is in no way limiting. The detailed description, therefore, is not to be taken in a limiting sense, and the scope of the present invention is defined by the appended claims.

The invention claimed is:

1. A retail system comprising:

a rack assembly including:

a stand that is adapted to rest on a substantially horizontal surface, where the stand is formed of a plurality of tubular members; and a mounting frame that is substantially rectangular in shape and supported in a substantially vertical position by the stand;

a cover including:

a base portion that is formed by a combination of a first shell and a second shell that is complementary to the first shell, the base portion defining a hollow, substantially box-like structure that is supported in a substantially vertically position by the rack assembly and covers at least a portion of the mounting frame; and a stack portion defining a hollow, substantially box-like structure that is adapted to slide over the mounting frame and mount atop the base portion; and light filtering means for filtering ambient, overhead lighting, the light filtering means being mounted atop the stack portion.

2. The retail system of claim 1, wherein the base portion and the stack portion define substantially similar transverse outer perimeters.

3. The retail system of claim 1, wherein the stack portion of the cover includes a plurality of substantially horizontally extending and reinforced through slots.

4. The retail system of claim 1, wherein the cover is formed of molded plastic.

5. The retail system of claim 1, wherein the first and second shells are each substantially U-shaped in transverse cross-section.

6. A racking system comprising:

means for supporting products on clothing hangers, the means including lower and intermediate cross-members;

means for covering the means for supporting products, the means for covering including:

a substantially hollow-bodied skirt that extends from a bottom to a top, the skirt being supported in a substantially upright position by the lower and intermediate cross-members;

a substantially hollow-bodied chimney that extends from a bottom to a top, the bottom of the chimney being mounted to the top of the skirt; and means for modifying ambient, overhead lighting, the means for modifying ambient, overhead lighting being mounted to the top of the chimney and including:

a ring;

a base mounted to the top of the chimney and supporting the ring; and a lens supported by the ring and adapted to pass at least some ambient, overhead lighting.

7. The system of claim 6, wherein the lens is formed of a substantially transparent sheet of plastic material.

8. The system of claim 6, wherein the means for modifying ambient, overhead lighting further comprises an indicia panel that is adapted to pass at least some of the ambient, overhead lighting, the indicia panel being arranged on top of the lens and having visual indicia viewable through the lens.

9. The system of claim 6, wherein the ambient, overhead lighting is fluorescent lighting suspended from a ceiling in a retail environment.

10. The system of claim 6, wherein the means for covering includes a first half and a second half formed distinctly from the first half, the first and second halves being arranged together in a clam shell configuration around the means for supporting products on clothing hangers.

11. The system of claim 6, wherein the chimney has a front face, an interior, and a plurality of substantially horizontal hanging slots used for supporting at least one bracket, the bracket including an upper portion, a step portion, and a lower portion, where the upper portion is substantially upright, the step portion extends substantially orthogonally from the upper portion, and the lower portion extends substantially orthogonally to the step portion such that the lower portion is substantially parallel with, and offset from, the upper portion, the hanging slots being formed through the front face of the chimney, and further wherein the chimney includes a reinforcement rib extending substantially vertically inside the chimney behind the hanging slots to reinforce the hanging slots during use for supporting the bracket.

12. The system of claim 6, wherein the lens has a generally circular outer perimeter, the lens including two, distinct semicircular panels that combine to form the lens.

13. A display system comprising:

a rack assembly supported on a retail floor, the rack assembly extending substantially vertically upward to terminate at a substantially flat top, the rack assembly including:

a stand that is adapted to rest on a substantially horizontal surface, where the stand is formed of a plurality of tubular members, and a mounting frame that is substantially rectangular in shape and supported in a substantially vertical position by the stand; and a cover including:

a base portion that is formed by a combination of a first shell and a second shell that is complementary to the first shell, the base portion defining a hollow, substantially box-like structure that is supported in a substantially vertically position by the rack assembly and covers at least a portion of the mounting frame, and a stack portion defining a hollow, substantially box-like structure that is adapted to slide over the mounting frame and mount atop the base portion; and a ceiling display assembly supported from a ceiling above the retail floor, the ceiling display assembly extending substantially vertically downward from the ceiling at a position laterally adjacent to the rack assembly and terminating at a substantially flat bottom that is at about a same height as a height of the substantially flat top of the rack assembly such that the rack assembly and the ceiling display assembly combine to define a visual horizon line at a desired elevation in a retail environment.

14. The display system of claim 13, wherein the rack assembly has an upward plume and the ceiling display assembly has a downward plume.

15. The system of claim 13, wherein the rack assembly further comprises a light filter adapted to modify ambient, overhead lighting.

16. The display system of claim 13, wherein the ceiling display assembly comprises:

a hanger including:

a body having a first end and a second end, a first end treatment at the first end of the body that is adapted to be secured to the ceiling, and a hanger bracket at the second end of the body;

a mounting ring having an open interior, the mounting ring being substantially circular in shape and secured to the hanger bracket;

a lens supported by the mounting ring, the lens being substantially circular in shape and adapted to permit light to pass therethrough; and an indicia insert adapted to allow light to pass therethrough, the indicia insert being supported by the mounting ring on top of the lens, and the indicia insert having indicia viewable through the lens.

17. The display system of claim 16, wherein the body is substantially arcuate, the first end of the body has a first end ring that is attached to the mounting ring, and the second end of the body has a second end ring that is attached to the mounting ring.

18. The display system of claim 17, wherein the body of the hanger includes a tubular sheath and an inner wire extending within the sheath.

19. The display system of claim 18, wherein the first end treatment includes a loop formed by the inner wire and a bracket connected to the loop and adapted to be secured to the ceiling above the retail floor.

20. The display system of claim 13, wherein the rack assembly further comprises light filtering means for filtering ambient, overhead lighting, the light filtering means being mounted atop the stack portion of the cover.

21. The display system of claim 13, wherein the base portion and the stack portion define substantially similar transverse outer perimeters.

22. The display system of claim 13, wherein the stack portion of the cover includes a plurality of substantially horizontally extending and reinforced through slots.

23. The display system of claim 22, further comprising:

one or more accessories mounted to the cover via one of the plurality of substantially horizontally extending and reinforced through slots; and merchandise for retail sale supported for display via the one or more accessories.

24. The display system of claim 13, wherein the first shell and the second shell are each substantially U-shaped in transverse cross-section.

* * * * *